US005551642A

United States Patent [19]

Dunn

[11] Patent Number: 5,551,642

[45] Date of Patent: Sep. 3, 1996

[54] ELECTROSTATIC DISPERSING APPARATUS

[75] Inventor: John P. Dunn, Hammondsport, N.Y.

[73] Assignee: Advanced Electrostatic Technologies, Inc., Hammondsport, N.Y.

[21] Appl. No.: 153,589

[22] Filed: Nov. 17, 1993

Related U.S. Application Data

[63] Continuation-in-part of Ser. No. 924,897, Aug. 4, 1992, abandoned.

[51] Int. Cl.[6] ..... B02C 19/00

[52] U.S. Cl. ..... 241/47; 241/79.1; 241/301

[58] Field of Search ..... 241/301, 79.1, 241/1, 5, 30, 47; 209/2, 250

[56] References Cited

U.S. PATENT DOCUMENTS

| | | | |
|---|---|---|---|
| 1,297,159 | 3/1919 | Hedberg . | |
| 2,361,946 | 11/1944 | Johnston et al. | 209/127 |
| 2,707,556 | 5/1955 | Gear et al. | 209/127 |
| 2,803,344 | 8/1957 | Morrison | 209/127 |
| 2,848,108 | 8/1958 | Brastad et al. | 209/127 |
| 3,059,772 | 10/1962 | Le Baron | 209/127 |
| 3,346,110 | 10/1967 | Lafranca, Jr. et al. | 209/2 |
| 3,401,795 | 9/1968 | Tauveron | 209/12 |
| 3,511,366 | 5/1970 | Dolgopolov | 209/12 |
| 3,635,340 | 1/1972 | Dunn | 209/130 |
| 3,787,034 | 1/1974 | Shvartsman et al. | 241/1 X |
| 4,071,169 | 1/1978 | Dunn | 222/76 |
| 4,172,028 | 10/1979 | Dunn | 209/12 |
| 4,229,285 | 10/1980 | Wild | 209/3 |
| 4,632,315 | 12/1986 | Watanabe et al. | 241/26 |
| 4,632,316 | 12/1986 | Watanabe et al. | 241/26 |
| 4,653,697 | 3/1987 | Codina | 241/1 |
| 4,880,530 | 11/1989 | Frey | 209/380 |
| 5,183,214 | 2/1993 | Zakheim et al. | 241/30 |
| 5,484,061 | 1/1996 | Dunn | 209/127.4 |

FOREIGN PATENT DOCUMENTS

| | | | |
|---|---|---|---|
| 0720159 | 3/1980 | U.S.S.R. | 241/301 |

*Primary Examiner*—John Husar
*Attorney, Agent, or Firm*—Barnard, Brown & Michaels

[57] ABSTRACT

This invention utilizes the oscillation which is produced in a powder which is acted upon by an electrostatic field. The disperser accomplishes its task by electrically charging the powder in a high voltage DC filed or by contact with a charging electrode, this causes the powder to become polarized and repel or disperse into discrete particles. The passing of particles from one electrode toward a second of opposite polarity will place a charge on the particle which causes oscillation, dispersion and movement toward the second electrode. Additional dispersion of the powder takes place as the particles oscillate and impact against the electrodes during the decent through the apparatus. Particle oscillation is related to particle polarity changes that occur as the particles traverse through the system.

9 Claims, 7 Drawing Sheets

ELECTROSTATIC DISPERSING APPARATUS

CROSS REFERENCE TO RELATED APPLICATIONS

This is a continuation-in part application of application Ser. No. 07/924,897, filed Aug. 4, 1992 now abandoned.

FIELD OF THE INVENTION

The present invention relates to apparatus and method for dispersing particles which are capable of moving in an electrostatic field and more particularly relates to apparatus and method for dispersing particles by oscillating the particles between two electrodes.

BACKGROUND OF THE INVENTION

It is often necessary to provide a flow of powdered bulk material to processing machinery or analyzing equipment. Feeders are used for controlling the input of bulk materials in operations such as packaging, batching, grinding, weighing, flaking, freezing, drying and mixing. Sometimes, the accurate feeding of these particles is negatively affected by the properties of the powder being fed into the system.

The powder can have a wide particle size distribution and the larger particles can mask the presence of of smaller particles during analysis. Fine powders can cluster into larger particles because of static charges. The particle morphology can tend to allow the particles to interlock mechanically to form larger clumps. Furthermore, some powders consist of large particles with small satellite particles adhering to the surface. One common prior art method of dispersing the powdered material is to place the material in a vibratory tray to dislodge and transport the powder. These "vibratory feeders" are manufactured by a number of companies, including FMC Corporation of Homer City, Pa. The powder-filled tray or trough, mounted on flexible springs, is vibrated at a high speed (30–60 Hz) by an electromagnetic drive.

These prior art vibratory dispersers have a number of problems in some applications, especially when processing fine layers or small quantities of powder. Often the mechanical forces created in the vibratory dispersers are not sufficient to disloge clumped powder. Furthermore, the vibratory dispersers can actual increase the clustering of material due to static charges.

It is thus an object of the invention to provide a powder disperser which can quickly and efficiently disperse particles.

The vibratory dispersers have no way of controlling the charge, or lack thereof, of the particles exiting the dispersion system. This can be extremely important for analysis work where the charge of the particle may affect the way the particle is detected by the analysing equipment. In some instances, the static charge remaining on the particles may cause clumping to reoccur almost immediately when the particles exit the system.

It is thus an object of the invention to provide a powder disperser which can quickly and efficiently disperse particles and control the charge of the dispersed particles exiting the system.

Electrostatic energy is a unique force. Harnessing this force has created exciting applications, copying, particle accelerators, dust and smoke precipitators, etc. A new application applies to the field of particle dispersion.

The concept of passing particles through an electrostatic field for the purpose of propelling the particles beyond a screen is disclosed in U.S. Pat. No. 3,635,340 to Dunn. This patent discloses the use of article momentum produced by pulling the particles across a field to propel particles through a printing screen. Further, it is also disclosed that this propulsion of the particles beyond a second electrode may be used for possible particle classification. This patent, however, does not recognize or utilize particle oscillation as the vehicle for dispersion of the particles.

SUMMARY OF THE INVENTION

The present invention disperses powder into discrete particles. Once the powder is in this dispersed state, further processing is more effecient and reproducible.

This invention utilizes the oscillation which is produced in a powder which is acted upon by an electrostatic field. The disperser accomplishes its task by electrically charging the powder in a high voltage DC field or by contact with a charging electrode, this causes the powder to become polarized and repel or disperse into discrete particles. The passing of particles from one electrode toward a second of opposite polarity will place a charge on the particle which causes oscillation, dispersion and movement toward the second electrode. Additional dispersion of the powder takes place as the particles oscillate and impact against the electrodes during the decent through the apparatus. Particle oscillation is related to particle polarity changes that occur as the particles traverse through the system.

Further objects of the invention will be set forth in the description which follows, and become apparent to those skilled in the art upon examination of the specifications or by practice of the invention.

DETAILED DESCRIPTION

The advantages and benefits of using the dispersing electrostatic apparatus and methods of the present invention include: 1) powders separate into discrete particles, 2) agglomerated or clusters of particles are dispersed, 3) finer particles adhering to the surface of larger particles are striped, leaving a cleaner, large particle, 4) magnetized powders are demagnetized, and 5) the charge of the particles leaving the system can be controlled.

Observation has shown that particles made up of finer particles, (clusters), are mixes of the basic metal plus oxides or oxide surface coated particles, bonded together by electrostatic forces. Fine particles adhering to the larger particles have also been traced to oxides. Both the fine particles and oxides can be stripped from the larger particle by the electrostatic dispersion process.

Figure 1:
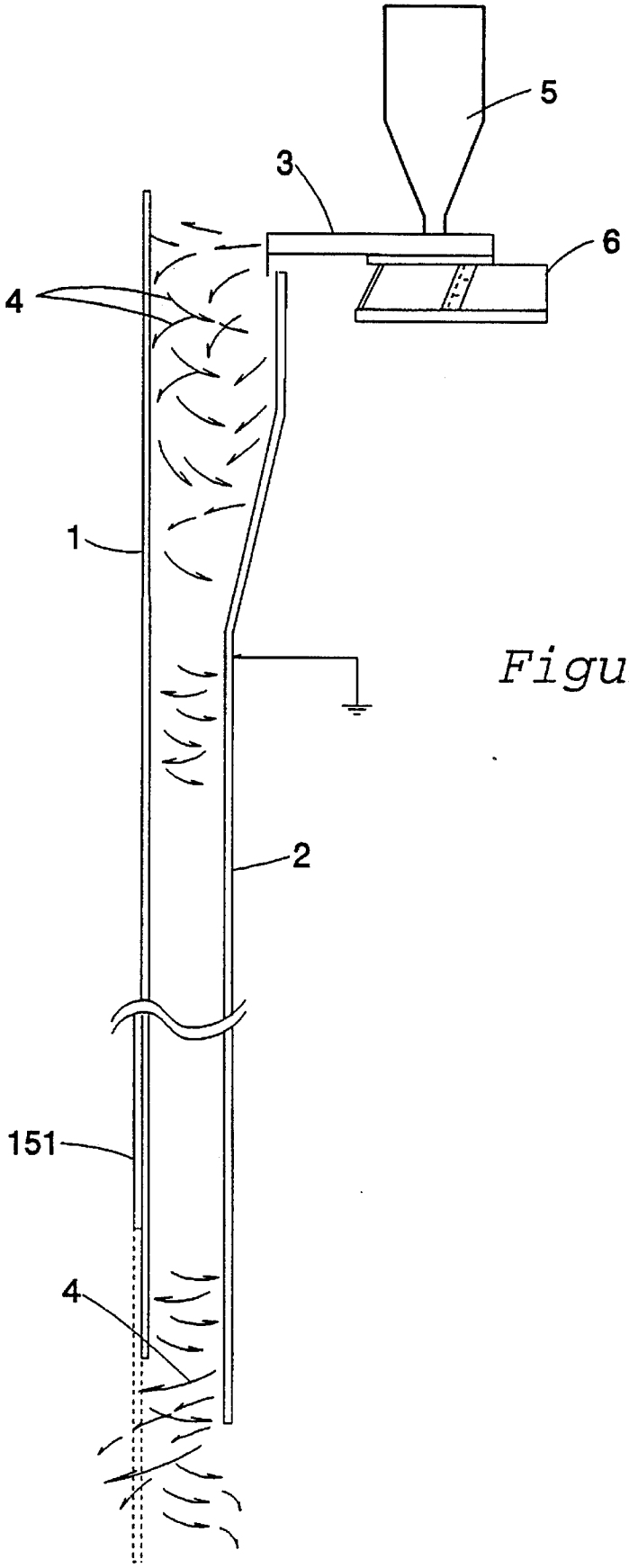
FIG. 1 is a cross sectional view of one embodiment of a disperser of the present invention.

Referring now to FIG. 1, a cross sectional view is shown of one embodiment of a dispersing apparatus of the present invention. The powder enters the dispersing apparatus at a controlled rate and is immediately dispersed by inductive charging. Because it is an electrostatic system the particles can change their polarity by contact. The end result is that the particles move back and forth (oscillate) at a rate dependent upon the spacing between electrodes, the potential or field strength, the specific gravity, the rate of powder input, the particle size and distribution, electrical properties of the material, the moisture content of the material and the operating angle of the charging electrode.

In the electrostatic sieving process, powders basically flow downward and laterally between the electrode 1 and 2. A specific problem is related to the powder leaving the ends of the feeder tray 3 and being repelled laterally by other particles as their progress down between the two electrodes 1 and 2. If this lateral flow is not controlled the number of oscillations of the particles may not be sufficient to disperse them completely Another problem that is related to the control of lateral flow is the control input of fine and very fine powders. For fine powders the desired powder input is a monolayer of powder distributed uniformly across the width of the feeder tray. With very fine powder, <20 microns, the tendency is for the powder to channel and flow in several layers. Erratic and random powder input can cause an overdose of particles, leading to a possible momentary electrical short along with a variation of the electrical field strength.

The methods used to control these problems include: 1) pulsing the powder input, 2) using channeled feeder trays, 3) adjusting the electrode so that it is on an angle producing a wider opening at the top then the bottom, and 4) placing one electrode directly in front of the feeder tray exit.

Pulsing the powder input substantially reduces both problems by essentially controlling the gas to solids ratio or the spatial density of particles.

Figure 3:
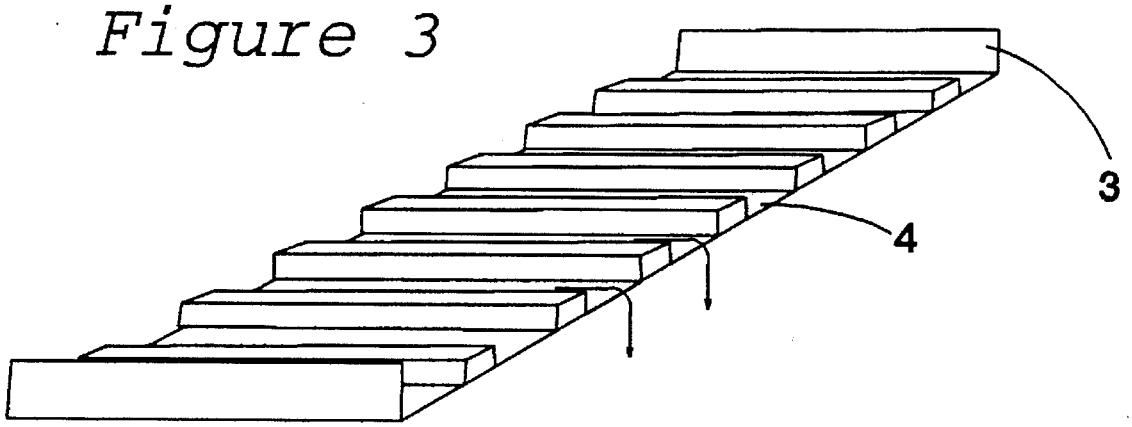
FIG. 3 is a detail view of a feeder tray used to feed particles to a dispersing apparatus of the present invention.

FIG. 3 shows another method used to control lateral powder dispersion. FIG. 3 is a detail view of a feeder tray 3 used to feed particles to a sieving apparatus of the present invention. The feeder tray 3 has a number of channels 4 that may vary in width and location. The most effective embodiment was to add channels at each end leaving the center open.

Figure 4:
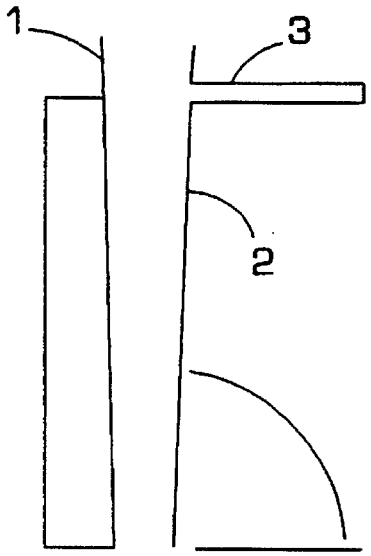
FIG. 4 is a representational diagram showing the ability to adjust the spacing between the electrodes such that a taper is created.
Figure 5A:
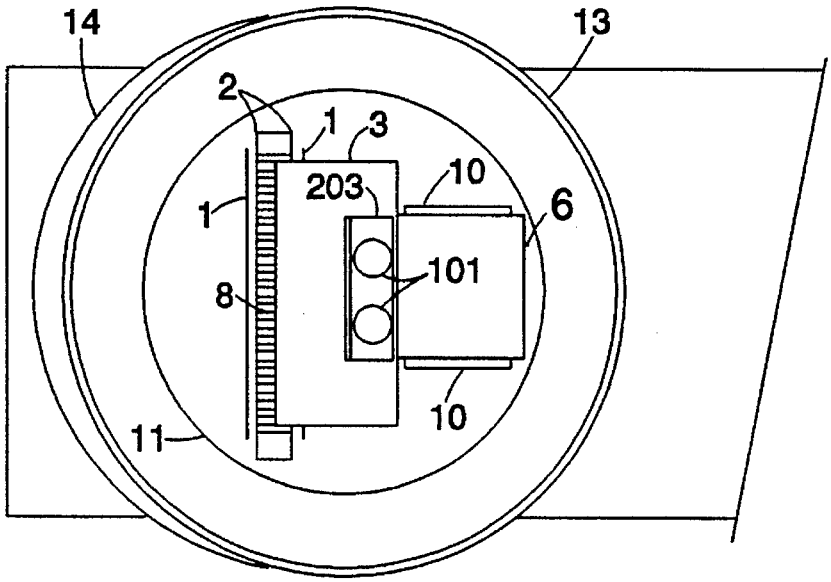
FIGS. 5*a* and 5*b* are cross sectional top and side views of a rectangular-splitter disperser that uses a powder splitter that distributes the powder between two rectangular dispersers.
Figure 5B:
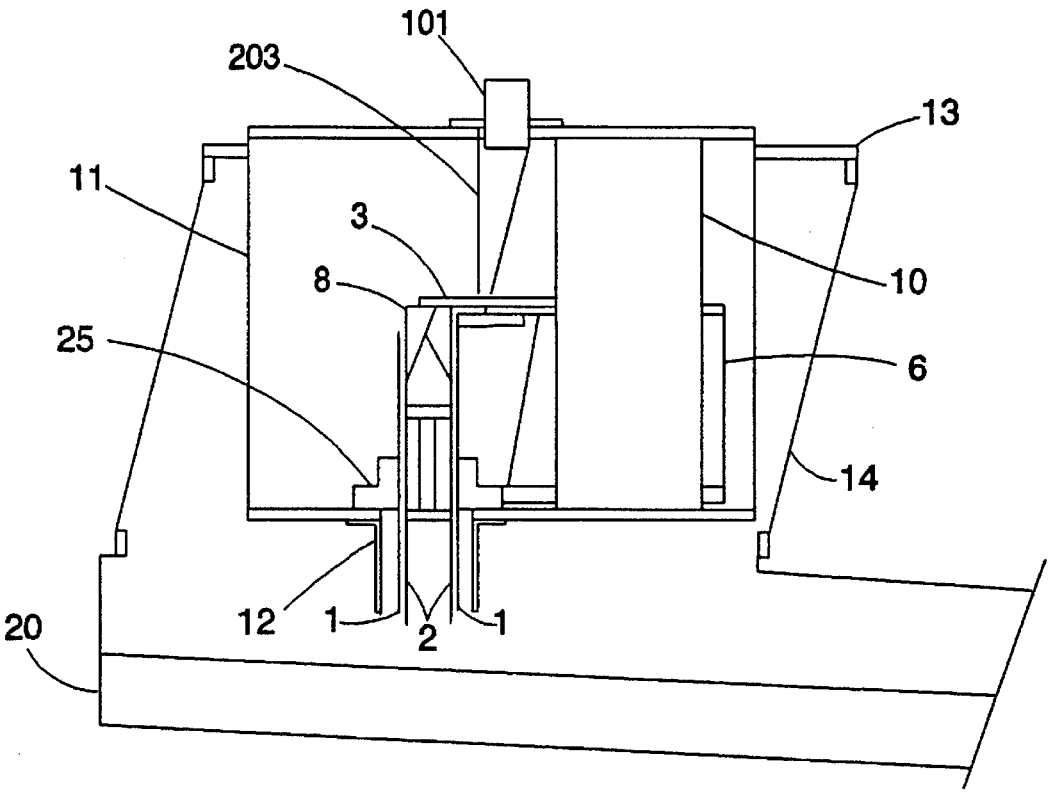

FIG. 4, shows another effective way of controlling problems related to powder input. FIG. 4 is a representational diagram showing the ability to adjust the spacing between the sieve and solid electrodes 1 and 2 such that a taper is created. The taper should be slight 0–3 degrees with the optimal range of 0.5–2.0 degrees 25. The process of sieving would include adjusting the spacing between the electrodes 1 and 2 such that a taper can be created in said spacing of the electrodes 1 and 2 extending the length of the electrodes 1 and 2. By angling the solid electrode 2 at the base 0.5 to 2.0 degrees a gradient electrical field is produced that allows the powder to gradually become influenced by the electrical field thereby distributing the dispersion over a greater length of the electrode 1.

As a powder disperser, its function is to provide discrete particles to other powder processing equipment, such as other types of sieving devices, powder blenders or mixing equipment. The electrostatic dry powder disperser can either be linear, cylindrical, tubular or conical in shape.

A cross section of the basic unit is shown in FIG. 1. A two electrode system is shown, a charging electrode 1, a grounded or oppositely charged electrode 2, a powder input area 3. The powder is charged by induction and the oscillates in the region between electrodes where oscillation of particles occurs.

Figure 2:
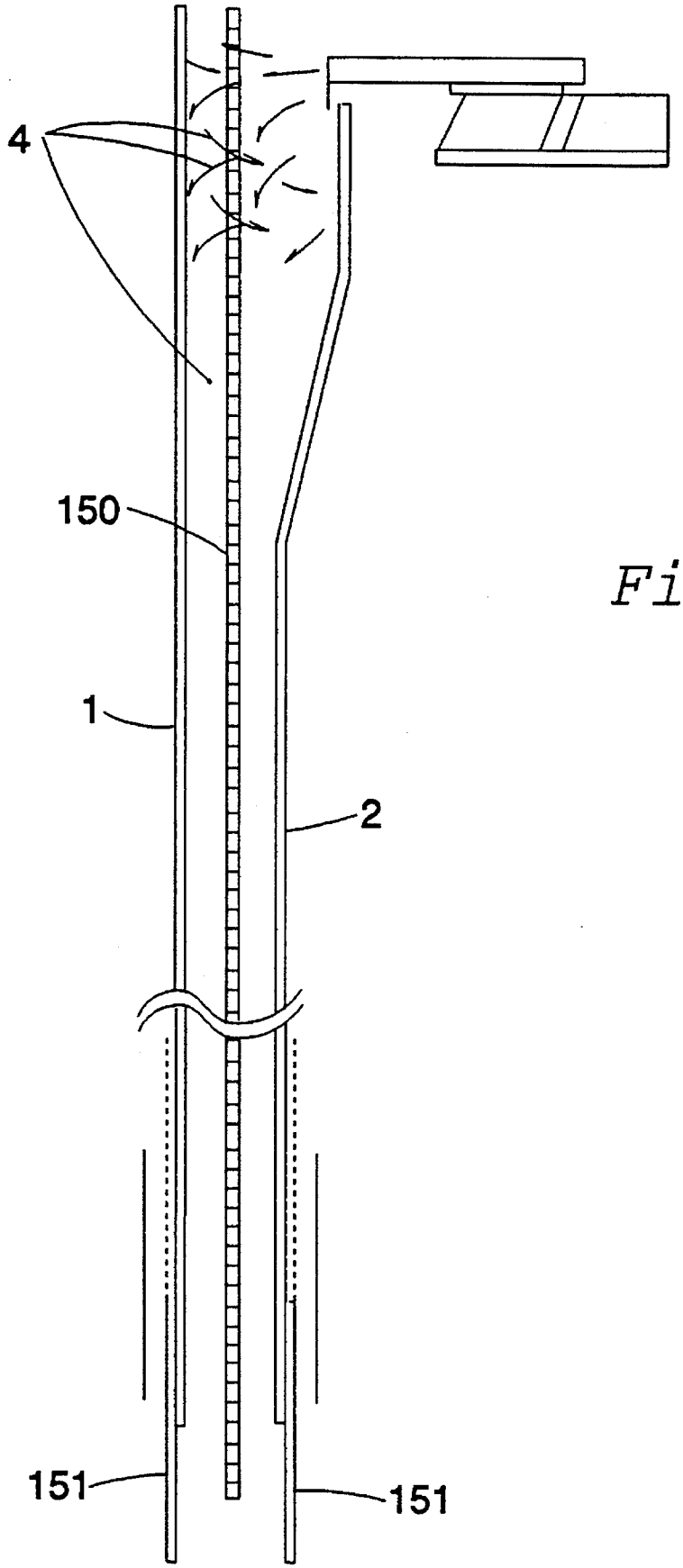
FIG. 2 is a cross sectional view of a second embodiment of a disperser of the present invention.

FIG. 2 shows a three electrode system, designed to induce greater physical agitation and stress on the particles and to increase the amount of powder that can be processed per unit length of electrode. This is accomplished because the powder can oscillate in both channels. The center electrode 150 is a charging grid electrode located between the two grounded of oppositely charged electrodes 1 and 2. FIG. 2 also illustrates how the charge status is controlled on particles leaving the system. The diagram shows adjustable electrode section 151 in the position to reduce the charge on particles, meaning that the electrodes 1 and 2 are in a grounded state. Lifting these sections would leave the center charging electrode exposed causing particles leaving the system to be attracted and charged.

The center electrodes 150 can be fabricated from woven wires or parallel horizontal wires oriented in such a way that they slow the particles decent, and increase the number of particle oscillations per unit length of electrode. The electrodes (1, 2 and 150) attidute, vertical, angular or horizontal, can affect the overall efficiency of dispersion.

It should be noted that if the electrodes 1 and 2 were in the position shown in FIG. 2 and not grounded but charged, the powder would stand a greater chance of leaving the system in an electrically charged state. The degree of charge would be related to the dielectric properties of the powder. FIG. 1 also shows an adjustable electrode section 151. If the adjustable electrode 151 were in the down position the particles would leave the system in a charged state. If the adjustable electrode 151 were in the up position the particles would leave the system in an uncharged state.

FIGS. *5a* and *5b* show a rectangular-splitter disperser that uses a powder splitter that distributes the powder between two rectangular dispersers. The powder is fed through powder input tubes 101 into a powder hopper 203. The powder is fed to the feeder tray 3 on the feeder 6. The feeder 6 mechanically feeds the powder to the system by oscillating the feeder tray 3 back and forth. The feeder 6 is held in position by supports 10. As the powder is delivered into the system is it divided by the powder splitter 8 which is a series of alternating troughs that direct the powder to alternating sides of the disperser. Both sides of the disperser are basically the same in that the outside electrodes are the charging electrodes 1 and the inner electrodes are the deflecting electrodes 2. The charging electrodes 1 could be provided with an adjustable electrode 151 as shown in FIGS. 1 and 2.

The feeding system is surrounded by a cylindrical support unit 11. Which includes an electrode shield 12. The entire system is surrounded by a cylidrical support unit 13 which includes a flexible covering 14. These shields, coverings and support structure are provided to control the dispersion of powder exiting the system and to prevent injury to the operator from electrical shock or dispered powder.

The powder exiting the system can be fed to further processing equipment 20 which is illustrated merely as a block because the further processing equipment can be anything from seiving apparatus to measuring equipment. Currently, this embodiment of the invention is best used for dispersing and metering powder into sieving equipment.

Figure 6:
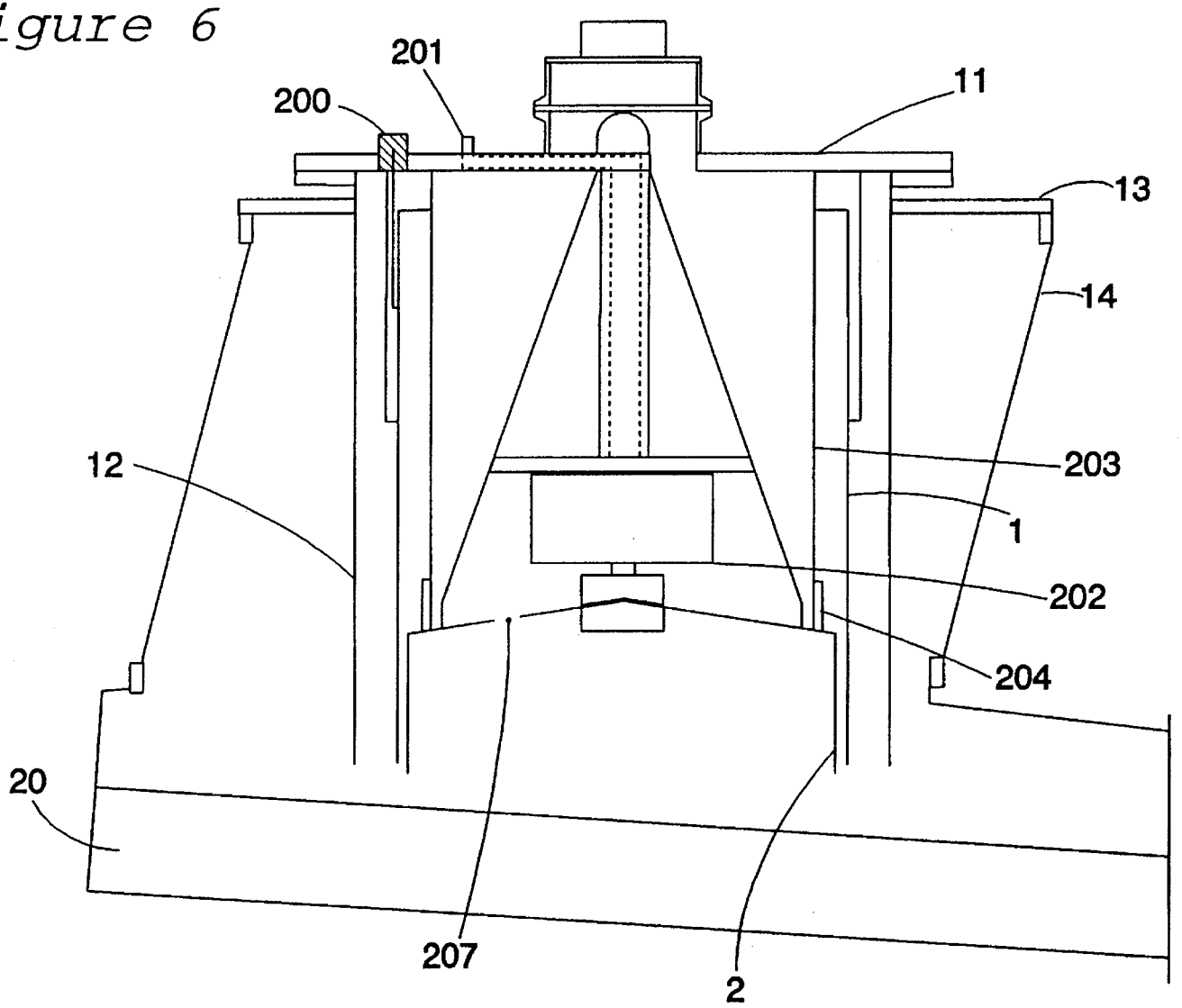
FIG. 6 is a cross sectional view of an embodiment of a rotary disperser of the present invention.

FIG. 6 shows a radial disperser designed to achieve a higher production rate per unit area. This unit can also be used as powder feeder in conjunction with a radial electrostatic sieve apparatus or mearsuring equipment and is especially useful for cylidrical sieving apparatus. A DC power input 200 is provided. Cooling gas (for example, nitrogen) and AC input come in through tube 201 to cool an power the rotating motor 202. Powder is provided in a powder hopper 203 and is controlled by a powder feed gate 204. The charging electrode 1 is stationary, while the grounded electrode 2 is rotating. Argon gas can be used in the dispersing system which would require sealing of the system. The output of the disperser could go directly into a sieving apparatus. A vent port 207 can also be provided in in the inside portion of the grounded The distance between electrodes is adjusted based on the material properties and electrical properties. The lower half of the charging electrode is adjusted for desired polarity of particles discharging from the apparatus. The power is turned on and voltage is adjusted for the desired field strength. Powder flow is started and adjusted to desired level of input. For most powdered materials dispersion takes place as soon as the powder enters the D.C. electric field established between the various electrodes 1 and 2.

To assure complete dispersion of powders, the electrode lengths extend one to eight inches from the entrance. Other operating parameters and equipment modifications can be made to accommodate different materials. A multi electrode arrangement can be used where the inner electrodes have different size apertures arranged in different patterns. The inner electrodes can be wires orientated in such a way that they slow the particles decent, (horizontal wires), and increase the number of particle oscillations per unit length of electrode. The electrodes attitude, vertical, angular or horizontal, can effect the overall efficiency of dispersion. The control and regulation of powder dispersion can be improved by introducing the powder into the system in controlled pulses or intermittently.

Figure 7:
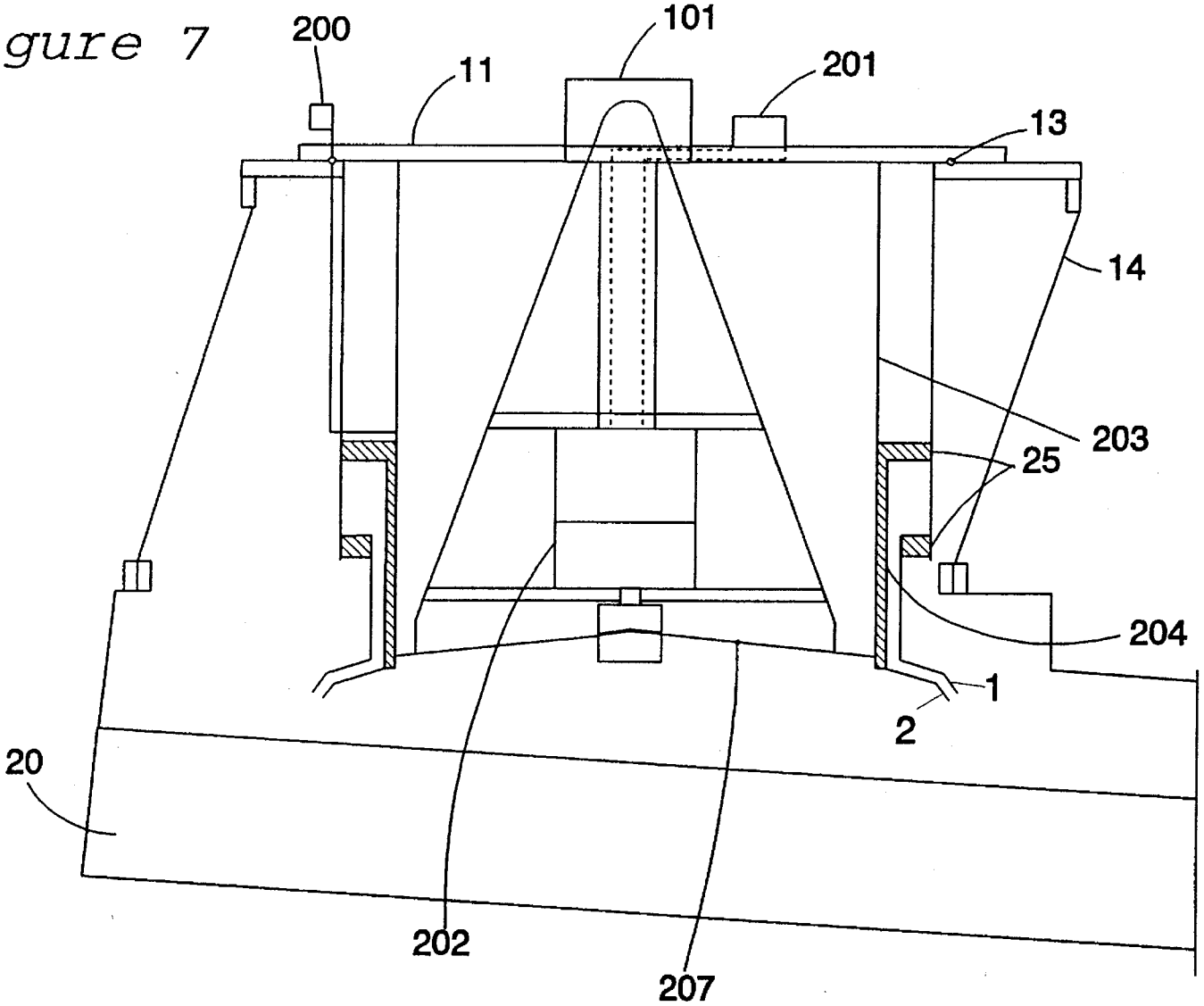
FIG. 7 is a cross sectional view of a second embodiment of a rotary disperser of the present invention.

FIG. 7 is a cross sectional view of a second embodiment of a rotary disperser of the present invention. The embodiment shown in FIG. 7 is structurally a bit different from the embodiment shown in FIG. 6. For example, dielectric supports 25 are shown. More importantly, the electrodes 1 and 2 are countered to be more horizontal than vertical. This merely illustrates that the angle of the electrodes can be varied depending upon the application.

Figure 8B:
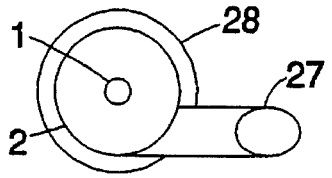
FIGS. 8*a* and 8*b* are a cross sectional and top view of tube disperser used in conjunction with a vacuum system to deliver dispersed particles.
Figure 8A:
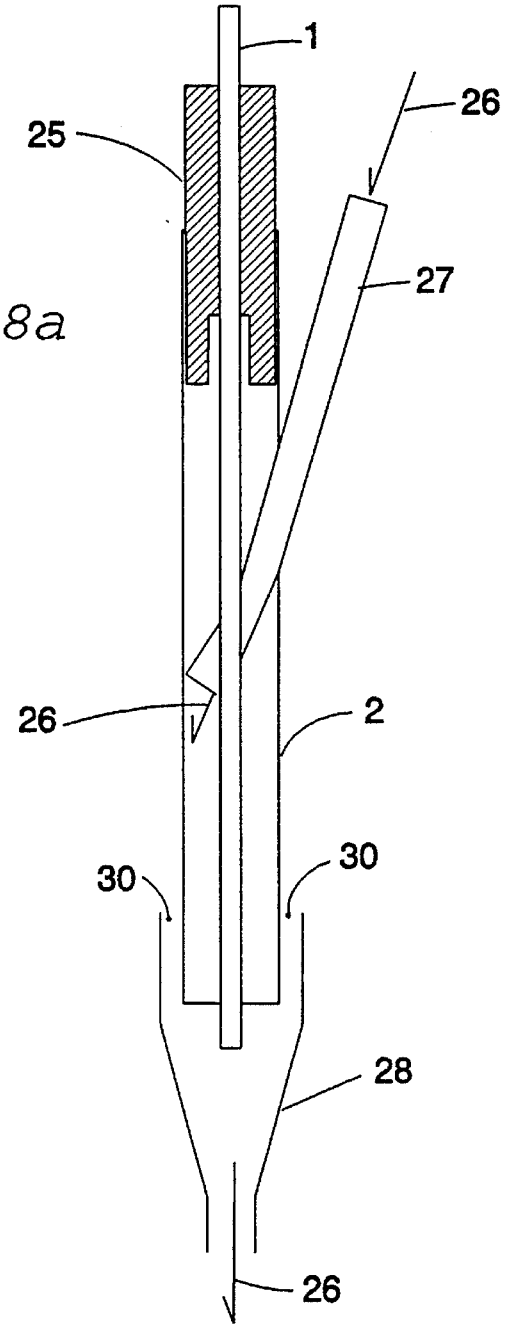

FIGS. 8*a* and 8*b* are a cross sectional and top view of tube disperser used in conjunction with a vacuum system to deliver dispersed particles. This embodiment is most often used with particle size measurement equipment. The solid (although it can be hollow as described below) inner rod is the charging electrode 1 and the outer cylindrical tube is the grounded (deflecting or attracting) electrode 2. The two electrodes are held in position by a dielectric support 25.

Arrows 26 show the flow of the powder through the unit. The powder is fed into the system through a tangental input tube 27. The system can be operated at an angle and the preferred mode of operation is to operate the unit such that the input tube 27 is vertical. This powder disperser functions by establishing a DC electric field potential of about 3 to 6 KV between the electrodes. The powder oscillates between the two electrodes as shown in FIG. 8*a*. The height of the charging electrode 1 can be altered. Raising the charging electode 1 up into the grounded electrode 2 will reduce the amount of charge retained by the particles as they leave the system.

The powder can be fed into the later processing equipment by the powder collection system 28. This system can draw air through the bottom of the unit as shown in FIG. 8*a* by the arrows 30 to carry the powder into later processing equipment. If the rod electrode 1 was hollow as oppossed to a solid electrode, air could be drawn through the inside of the rod electrode 1. Air is brought into the bottom of the unit to avoid drawing air through the powder input tube 27. This would cause the particles to prematurely exit the system with the drawn air.

FIG. 8*b* shows the input tube 27 offset from the radial center line of the tubular grounded electrode 2 so that the powder does not flow directly onto the charging electrode 1. This prevents major arcing when clusters of powder are introduced into the system.

The foregoing description has been directed to particular embodiments of the invention in accordance with the requirements of the Patent Statutes for the purposes of illustration and explanation. It will become apparent, however, to those skilled in the art that many modifications and changes will be possible without departure from the scope and spirit of the invention. It is intended that the following claims be interpreted to embrace all such modifications.

I claim:

1. An electrostatic particle oscillator for dispersing and comminuting articles comprising:

a) a source of direct potential having first and second terminals;

b) an electrode connected to said first terminal;

c) an electrode connected to said second terminal; and d) means for feeding particles to a transfer point located between said electrodes such that said particles disperse and oscillate between said electrodes;

wherein the length of one of said electrodes can be adjusted to control the charge of the dispersed particles exiting the apparatus.

2. The apparatus of claim 1 wherein said electrodes can be adjusted between 0 and 3 degrees.

3. The apparatus of claim 1 wherein one of said electrodes has sides that are contoured to produce an asymmetrical electrical field that deflects and confines powders to a process area between said electrodes yet maintains the strongest electrical field within said process area.

4. An electrostatic particle oscillator for dispersing and comminuting particles comprising:

a) a source of direct potential having first and second terminals;

b) an electrode connected to said first terminal;

c) a rotating electrode connected to said second terminal; and d) means for feeding particles to a transfer point located between said electrodes such that said particles disperse and oscillate between said electrodes;

wherein the direction of rotation of said rotating electrode is approximately perpendicular to the path of particles exiting the apparatus.

5. The apparatus of claim 4 wherein the length of one of said electrodes can be adjusted to control the charge of the dispersed particles exiting the apparatus.

6. The apparatus of claim 4 wherein said electrodes are contoured such that the surfaces of said electrodes are parallel to one another and said particles move between said electrodes in close to a horizontal direction.

7. An electrostatic particle oscillator for dispersing and comminuting particles comprising:

a) a source of direct potential having first and second terminals;

b) a rod shaped electrode connected to said first terminal;

c) a tubular electrode connected to said second terminal and surrounding said rod shaped electrode such that there is a gap between said rod shaped electrode and said tubular electrode; and d) means for feeding particles to a transfer point located between said electrodes such that said particles disperse and oscillate between said electrodes.

8. The apparatus of claim 7 wherein the length of one of said electrodes can be adjusted to control the charge of the dispersed particles exiting the apparatus.

9. The apparatus of claim 7 wherein the rod electrode is hollow and said apparatus includes a seal between the upper portion of said rod and tube electrodes and said particles are collected by a vacuum collection system that draws air through said rod electrode.

* * * * *